US009586726B1

(12) United States Patent
Moody et al.

(10) Patent No.: US 9,586,726 B1
(45) Date of Patent: Mar. 7, 2017

(54) DRAWSTRING TRASH BAG

(71) Applicant: Poly-America, L.P., Grand Prairie, TX (US)

(72) Inventors: Wade Morgan Moody, Fort Worth, TX (US); Brad A. Cobler, Irving, TX (US)

(73) Assignee: Poly-America, L.P., Grand Prairie, TX (US)

( * ) Notice: Subject to any disclaimer, the term of this patent is extended or adjusted under 35 U.S.C. 154(b) by 0 days.

(21) Appl. No.: 14/859,414

(22) Filed: Sep. 21, 2015

(51) Int. Cl.
*B65D 33/28* (2006.01)
*B65D 33/16* (2006.01)

(52) U.S. Cl.
CPC ..... *B65D 33/165* (2013.01)

(58) Field of Classification Search
CPC ..... B65D 33/28; B65D 33/165
USPC ..... 383/75
See application file for complete search history.

(56) References Cited

U.S. PATENT DOCUMENTS 5,120,138 A 6/1992 Midgley
5,133,607 A 7/1992 Bonke
5,232,118 A 8/1993 Samuel
6,059,458 A 5/2000 Belias
6,164,824 A 12/2000 McGlew
6,402,377 B1 6/2002 Vo
6,585,415 B2 7/2003 Malaspina
6,921,202 B2 * 7/2005 Raterman ..... B65F 1/0006 383/33
6,939,042 B2 9/2005 Rusnak
6,994,469 B2 2/2006 Sleight
7,758,243 B2 7/2010 Bonke
8,167,490 B2 5/2012 Hu
8,556,508 B2 10/2013 Persenda
8,657,495 B2 * 2/2014 Maxwell ..... B65D 33/28 383/53
8,877,307 B2 * 11/2014 Hall ..... B65D 33/28 383/62
9,284,098 B2 * 3/2016 Cobler ..... B65D 33/28
2003/0072505 A1 * 4/2003 Pihl ..... B29C 55/06 383/75
2004/0097357 A1 * 5/2004 Pihl ..... B65D 33/28 493/190
2005/0207681 A1 9/2005 Raterman
2010/0046860 A1 * 2/2010 Kent ..... B65F 1/0006 383/75
2010/0172602 A1 * 7/2010 O'Donnell ..... B32B 27/32 383/75

(Continued)

FOREIGN PATENT DOCUMENTS

EP 1013567 A1 6/2000
WO 2005016791 A1 2/2005

*Primary Examiner* — Jes F Pascua
(74) *Attorney, Agent, or Firm* — Daniel J. Layden; Brandon J. Lee

(57) ABSTRACT

The present invention is directed to a drawstring bag comprising a first panel and a second panel. The first panel and the second panel are joined along a first side, a bottom, and a second side. The first panel and the second panel thereby define an upper opening of the bag. The drawstring bag may further comprise a first pair of drawstrings disposed within a first hem along the upper opening of the bag in the first panel and a second pair of drawstrings disposed within a second hem along the upper opening of the bag in the second panel. The first pair of drawstrings may comprise a shorter elastic drawstring and a longer inelastic drawstring.

18 Claims, 7 Drawing Sheets

(56) References Cited

U.S. PATENT DOCUMENTS

Figure 1:
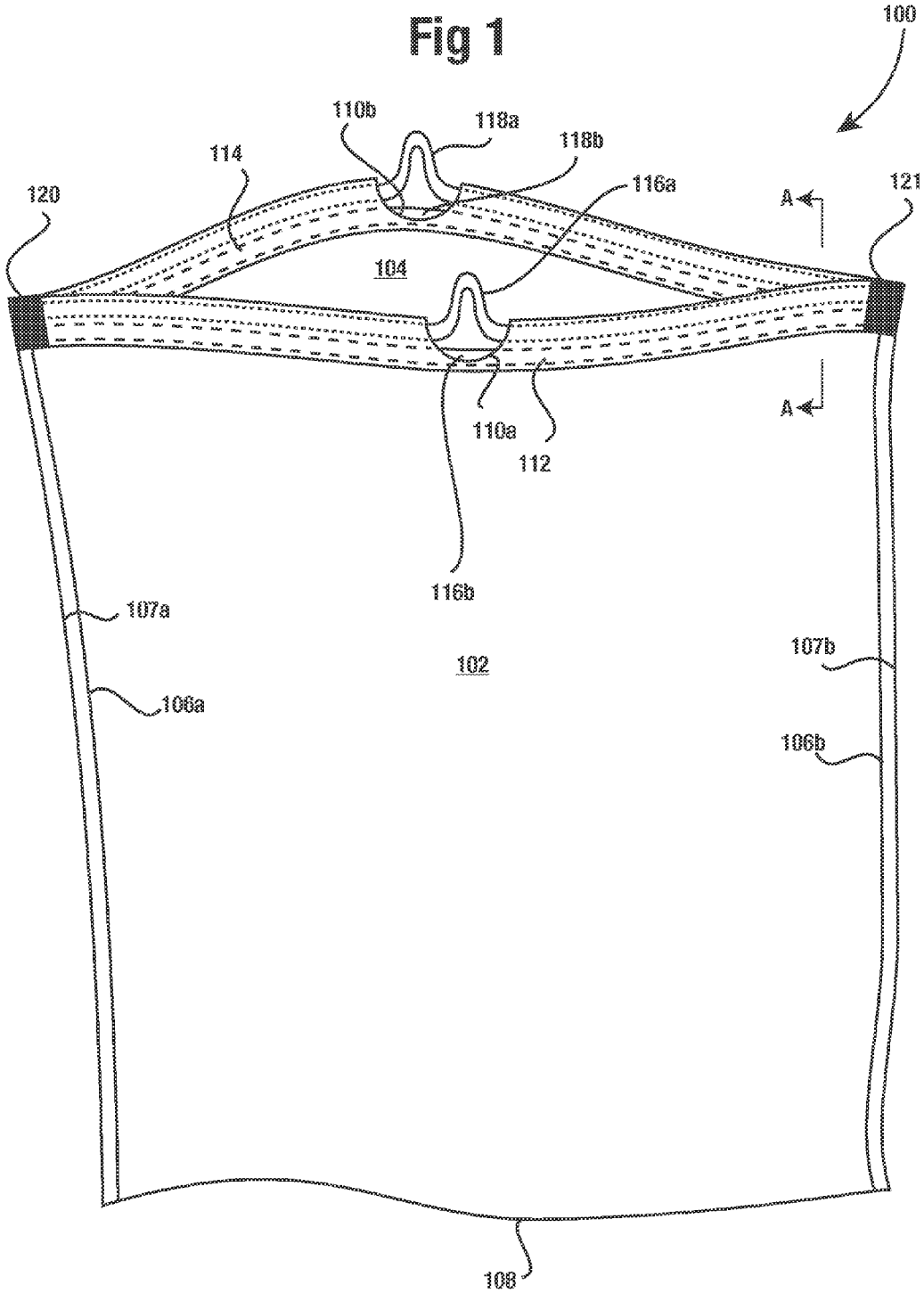

| | | | | |
|---|---|---|---|---|
| 2010/0303388 | A1* | 12/2010 | Kent | B31B 19/18 383/32 |
| 2011/0002559 | A1* | 1/2011 | Wood | B65D 33/28 383/75 |
| 2011/0052103 | A1 | 3/2011 | Hall | |
| 2011/0091137 | A1 | 4/2011 | Kent | |
| 2014/0254958 | A1 | 9/2014 | Cobler | |
| 2016/0046411 | A1* | 2/2016 | Kent | B65F 1/0006 383/75 |
| 2016/0096660 | A1* | 4/2016 | Kent | B31B 19/18 383/75 |
| 2016/0114939 | A1* | 4/2016 | Kent | B31B 19/18 24/30.5 P |

* cited by examiner

DRAWSTRING TRASH BAG

CROSS-REFERENCE TO RELATED APPLICATIONS

Not applicable.

BACKGROUND OF THE INVENTION

1. Field of the Invention

The present invention relates to improvements in polymeric bags. Specifically, the present invention relates to polymeric bags utilizing a drawstring and typically used for trash or refuse disposal. Moreover, the present invention relates to polymeric bags utilizing both an elastic and inelastic drawstring in the same hem of the bag.

2. Description of the Related Art

Polymeric bags are ubiquitous in modern society. Polymeric bags can be manufactured using woven polymeric materials or manufactured using thin polymeric films with one or more material layers. Applications for which polymeric bags may be utilized are numerous with variations of polymeric bags used in a number of different industries. Moreover, some polymeric bags may exhibit certain properties depending on the specific polymeric materials used in the manufacturing process.

The present invention relates primarily to thin-film bags, typically polyethylene bags, used for trash or garbage collection. Such bags are typically manufactured using a blown-film extrusion process, providing a film material for the trash bag body which is subsequently converted into a final product. Polyethylene trash bags are available in different sizes, thicknesses, and colors and typically incorporate one of three different closure methods: straight top bags with twist tie closures; flapped bags where the flaps can be used to secure, tie, and carry the bag; and drawstring trash bags where a drawstring is provided within each hem to provide a method for securing, tying, and carrying the trash bags. The present invention is of particular relevance to drawtapes used in drawstring trash bags.

Over the past decade drawstring trash bags have enjoyed increasing commercial success as consumers recognize such bags increased utility. This is particularly true with respect to domestic household use where drawstring trash bags are now the most popular type of trash bags used in kitchen settings.

Such drawstring bags typically feature a drawstring located within each hem and anchored to the upper corners of the bag. The drawstrings can be used to pull the trash bag closed, to secure the trash bag mouth closed by tying the drawstrings closed, and to provide handles for carrying the closed, filled trash bag. Traditionally, such drawstrings were manufactured using primarily high density polyethylene, which offers increased tensile strength when compared to linear low density polyethylene or low density polyethylene. However, new improved drawstrings are emerging which provide other features and functions, particularly with respect to securing the top of the drawstring trash bag onto a trash receptacle.

One solution for gripping the top of a trash receptacle is described in U.S. Pat. No. 5,133,607 (the '607 patent) entitled "Plastic Liner Bag with Elastic Top Tie Strip." The '607 Patent, which is incorporated herein by reference, describes using an elastic drawstring or band within the top of the drawstring bag. The elastic drawstring can be pulled outward at the top corners of the bag. Unfortunately, the elastic tie top requires relatively expensive elastomeric materials and a thicker gauge than traditional high density drawstrings.

Solutions have also been described for securing the top of the drawstring trash bag onto a trash receptacle using multiple drawtape elements. For instance, U.S. Pat. No. 6,164,824 (the '824 patent) entitled "Garbage Bag with Elastic Rim Edge Support," describes an elastic loop with a rest diameter, the elastic loop located within an upper edge of a loop space of a trash bag. The elastic loop is pulled over an outer rim of a trash receptacle to a stretch diameter. The bag is described as being fixed to the garbage receptacle as the elastic element attempts to resume its rest diameter. The '824 patent also describes a loop shaped plastic cinch element located in the same upper edge of the loop space that may extend outside an opening of the upper edge of the loop space which may be used to tie the top end of the garbage bag. Both the cinch element and the elastic element are described as a continuous loop. The '824 patent discloses costly and difficult to manufacture materials for the cinch element, such as a band of fibrous material. The '824 patent also discloses relatively expensive and bulky materials for the elastic element, such as natural rubber, that is only capable of carrying a small fraction of the weight of a full trash bag.

Another solution involving multiple drawstring elements includes U.S. Pat. No. 6,585,415 (the '415 patent) entitled "Expandable Garbage Bag." The '415 patent describes a drawstring garbage bag with inextensible ribbons disposed within hems at an upper opening of both sides of the bag. Further described is an elastic ribbon inserted into one of the two hems. Provided in at least the hem containing the elastic ribbon is a hole for accessing the ribbon. The elastic ribbon is configured so that it may be pulled out of the hem, once the bag has been placed in a container, and the hem wrapped over the top edge of the container, twisted, and wrapped around the outer circumference of the bag around the container to affix the bag to the container. The elastic ribbon requires a highly elastic material for stretching over the entire outer rim of a receptacle, adding considerable manufacturing costs to the garbage bag.

Another approach to improving drawstring trash bags is described in United States Published Patent Application No. 2011/0052103 (the '103 Application) entitled "Elastic Drawstring for Trash Bags," assigned to Applicant and hereby incorporated into this disclosure by reference in its entirety. The '103 Application discloses a blend of linear low-density polyethylene (LLDPE) and low-density polyethylene (LDPE) to provide a drawstring with elastic-like properties. Specifically, when the two polyethylene resins are used together as described in the patent application, the resultant material provides limited elastic properties, with the blended drawtape exhibiting a greater percentage of elongation before yielding than either of the two materials would exhibit alone. Moreover, a 3 mil drawtape according to the '103 Application can provide elastic recovery of approximately 80%, which is greater than either the LLDPE or the LDPE materials would exhibit individually.

A further improvement to the blended LLDPE and LDPE drawstring of the '103 Application is described in United States Published Patent Application No. 2014/0254958 (the '958 Application) entitled "Cold-Stretched Drawstring Trash Bag", assigned to Applicant and hereby incorporated by reference in its entirety into this disclosure. The '958 Application discloses a cold-stretch process applied to drawtape film that strain hardens the film, increasing the tensile strength at yield, and decreasing the elongation at yield of the film.

It would be advantageous to further improve the properties of the drawstring trash bag described in the '103 Application. For instance, it would be advantageous to improve the range of containers that a drawstring trash bag may be affixed to by using common polyethylene materials, such as high density polyethylene, linear low density polyethylene, and low density polyethylene. The above described '103 and '958 applications describe a bag that is capable of adhering to receptacle openings within a limited range. The below described invention provides a drawstring bag capable of easily adhering to a greater range of container openings while still being manufactured with the aforementioned common and low-cost polyethylene materials.

SUMMARY OF THE INVENTION

The present invention is directed to a drawstring bag comprising a first panel and a second panel. The first panel and the second panel are joined along a first side, a bottom, and a second side. The first panel and the second panel define an upper opening of the bag. The drawstring bag may further comprise a first hem located along the upper opening of the bag in the first panel. A first drawstring and a second drawstring may be disposed within the first hem. One or more short seals may weld together the first panel, the second panel, the first drawstring, and the second drawstring proximate to the first side. The first drawstring may have a working length greater than a working length of the second drawstring. The second drawstring may have an elongation at yield of less than 100%.

In at least one embodiment of the present invention, the first drawstring may have a first end located approximately above a first end of the second drawstring. The first end of the first drawstring may not overlap the first end of the second drawstring so that the entire height of the first end of the first drawstring is welded to an upper edge of the first panel and the first panel. A second end of the first drawstring may not overlap the second end of the second drawstring so that the entire height of the second end of the first drawstring is welded to an upper edge of the first panel and the first panel. A width of the first drawstring may be approximately one-half inch or less and a width of the second drawstring may also be approximately one-half inch or less. A thickness of the first drawstring may be less than a thickness of the second drawstring.

In at least one embodiment of the present invention, an inner bag opening length may be defined by an out-stretched distance between an inner edge of the one or more first short seals and an inner edge of the one or more second short seals. The working length of the second drawstring may be less than the inner bag opening length. The working length of the first drawstring may be equal to or greater than the inner bag opening length. Furthermore, in at least one embodiment, the first drawstring may be relatively inelastic and the second drawstring may be relatively elastic. The second drawstring may be comprised of a cold-stretched blended LLDPE/LDPE film and the first drawstring may be comprised of a HDPE film.

In another embodiment of the present invention, a drawstring bag may comprise a first panel and a second panel. The first panel and the second panel may be joined along a first side, a bottom, and a second side. The first panel and the second panel may define an upper opening of the bag. The drawstring bag may further comprise a first hem located along the upper opening of the bag in the first panel. A first drawstring and a second drawstring may be disposed within the first hem. The first panel, the second panel, the first drawstring, and the second drawstring may be welded together proximate to the first side. The first drawstring may have a working length greater than a working length of the second drawstring. The second drawstring may have an elongation at yield of less than 100%.

In at least one embodiment of the present invention, the second drawstring may have a yield strength of at least approximately five pounds. The second drawstring may also have a thickness of approximately 3 mils. The drawstring bag may also have an inner bag opening length defined by an out-stretched distance between an inner edge of the first side and an inner edge of the second side. In addition, the working length of the second drawstring may be less than the inner bag opening length. Also, the working length of the first drawstring may be approximately equal to the inner bag opening length. Additionally, the second drawstring may have a yield strength at least approximately 50% and less than 100% of a yield strength of the first drawstring.

In an alternative embodiment of the present invention, a drawstring bag may comprise a first panel and a second panel. The first panel and the second panel may be joined along a first side, a bottom, and a second side. The first panel and the second panel may thereby define an upper opening of the bag. A first hem may be located along the upper opening of the bag in the first panel. A first drawstring may be disposed within the first hem and may comprise a first drawtape and a second drawtape. A first surface of the first drawtape may be affixed to an adjacent first surface of the second drawtape. A width of the first drawtape may be greater than a width of the second drawtape and an elasticity of the first drawtape may be less than an elasticity of the second drawtape.

In at least one embodiment, the second drawtape may be stretched prior to being affixed to the second drawtape. Additionally, a length of the second drawtape may be stretched at least 10% and no more than 25% prior to being affixed to the first drawtape. Furthermore, the first drawtape may be affixed to the second drawtape with adhesive. The first drawtape may be affixed to the second drawtape intermittently defining a repeating pattern of affixed sections of the first drawtape affixed to the second drawtape and non-affixed sections of the first drawtape not affixed to the second drawtape.

BRIEF DESCRIPTION OF THE RELATED DRAWINGS

A full and complete understanding of the present invention may be obtained by reference to the detailed description of the present invention and preferred embodiments when viewed with reference to the accompanying drawings. The drawings can be briefly described as follows.

FIG. 1 provides a side view of a drawstring trash bag according to one embodiment of the present invention.

Figure 2:
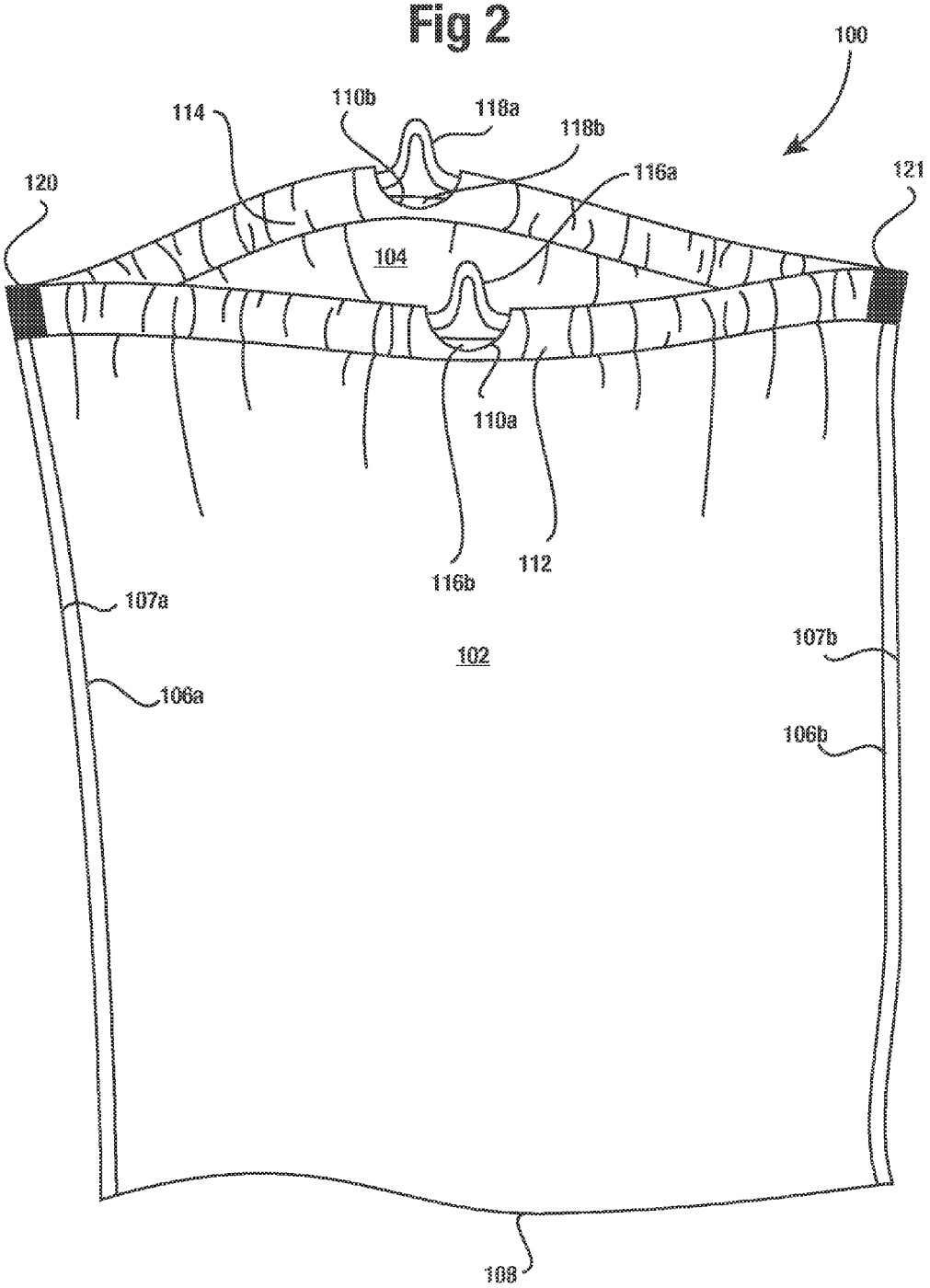

FIG. 2 provides an additional side view of the drawstring trash bag of FIG. 1 with gathering of the first and second hems shown and the hidden lines of the drawstrings within the first and second hems not shown.

Figure 3:
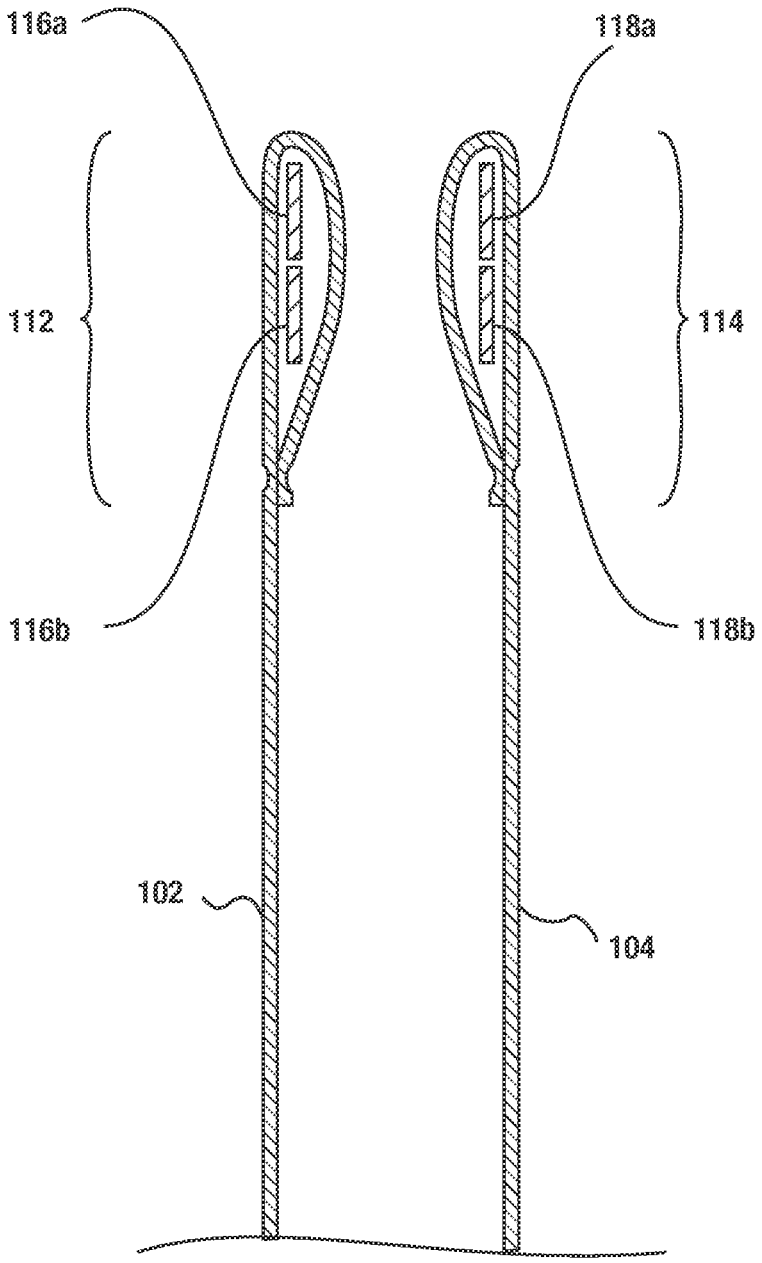

FIG. 3 provides a partial cross-sectional view of the drawstring trash bag of FIGS. 1 and 2 taken along line A-A of FIG. 1.

Figure 4:
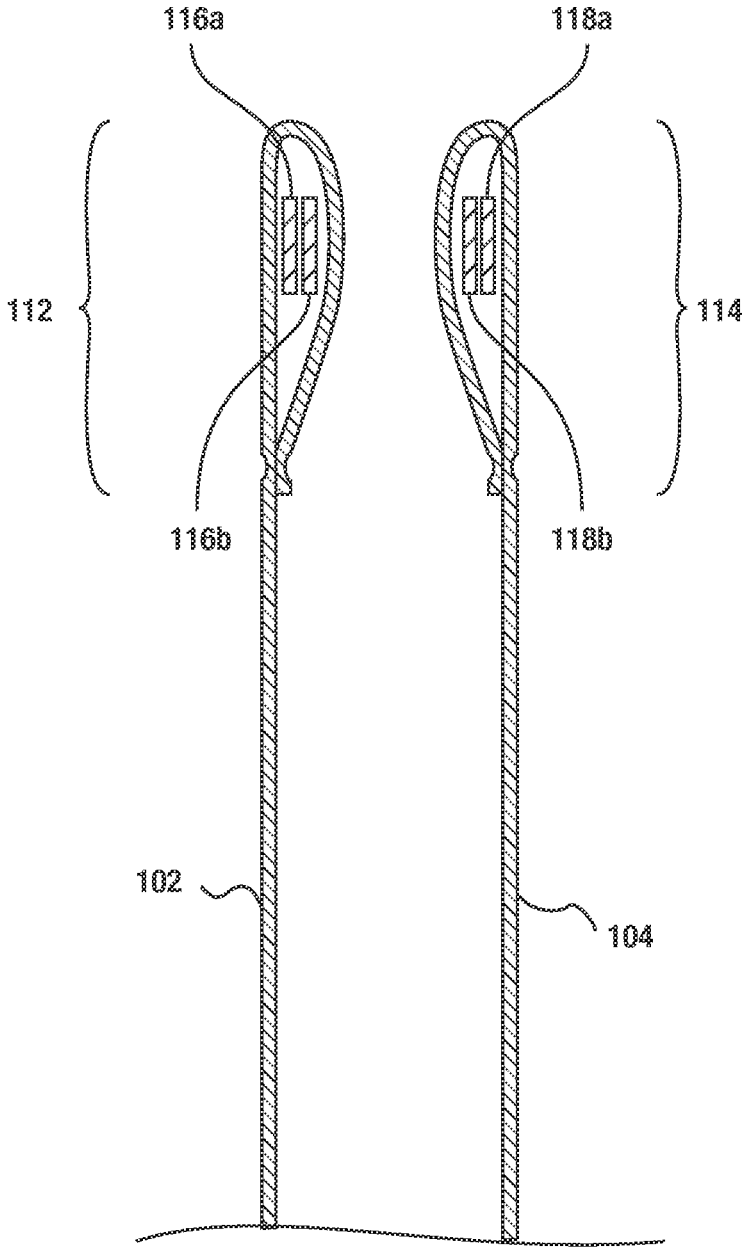

FIG. 4 provides a partial cross-sectional view of an alternative embodiment of the drawstring trash bag of the present invention.

Figure 5:
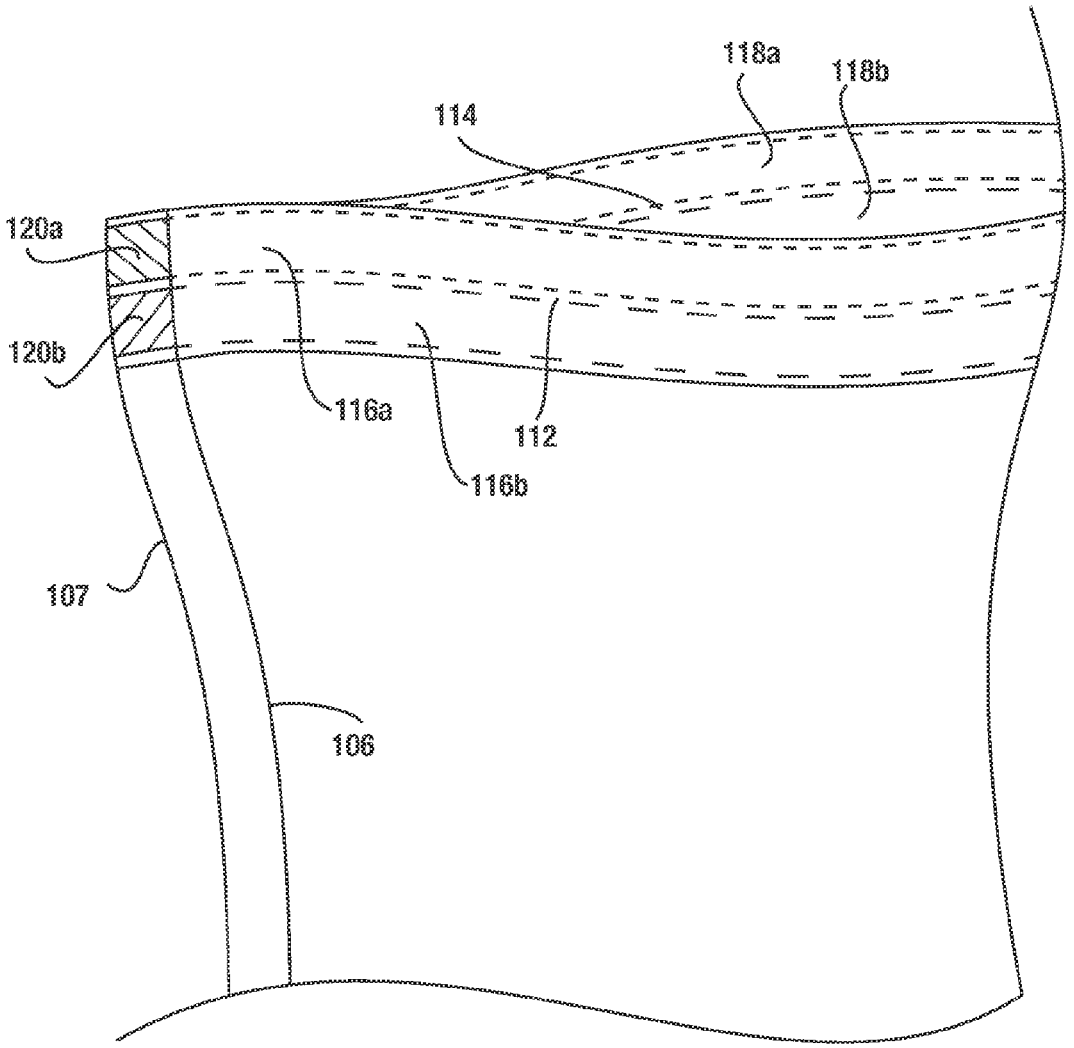

FIG. 5 provides a partial side view of an upper corner of the drawstring trash bag of FIGS. 1, 2, and 3.

Figure 6A:
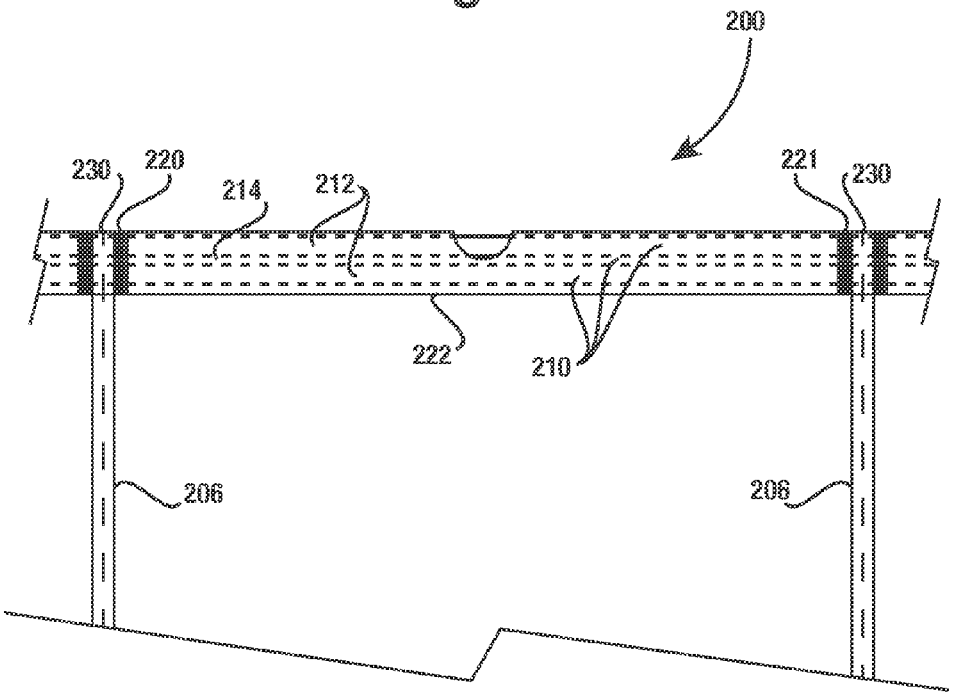

FIG. 6*a* provides a partial side view of a drawstring trash bag according to an alternative embodiment of the present invention.

Figure 6B:
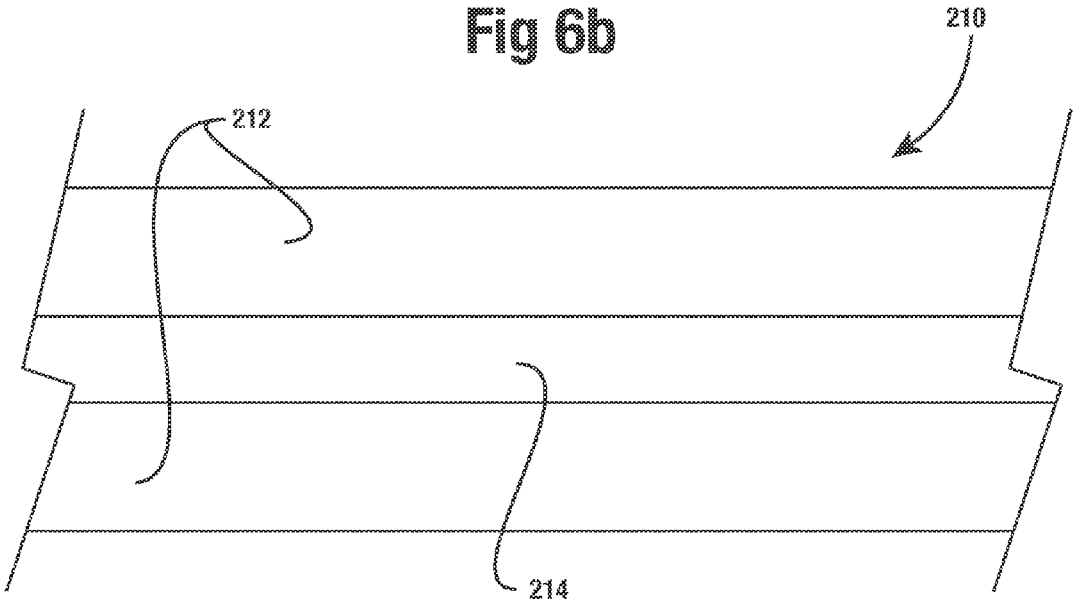

FIG. 6*b* provides a detailed partial view of the drawstring of the drawstring trash bag of FIG. 6*a*.

Figure 7:
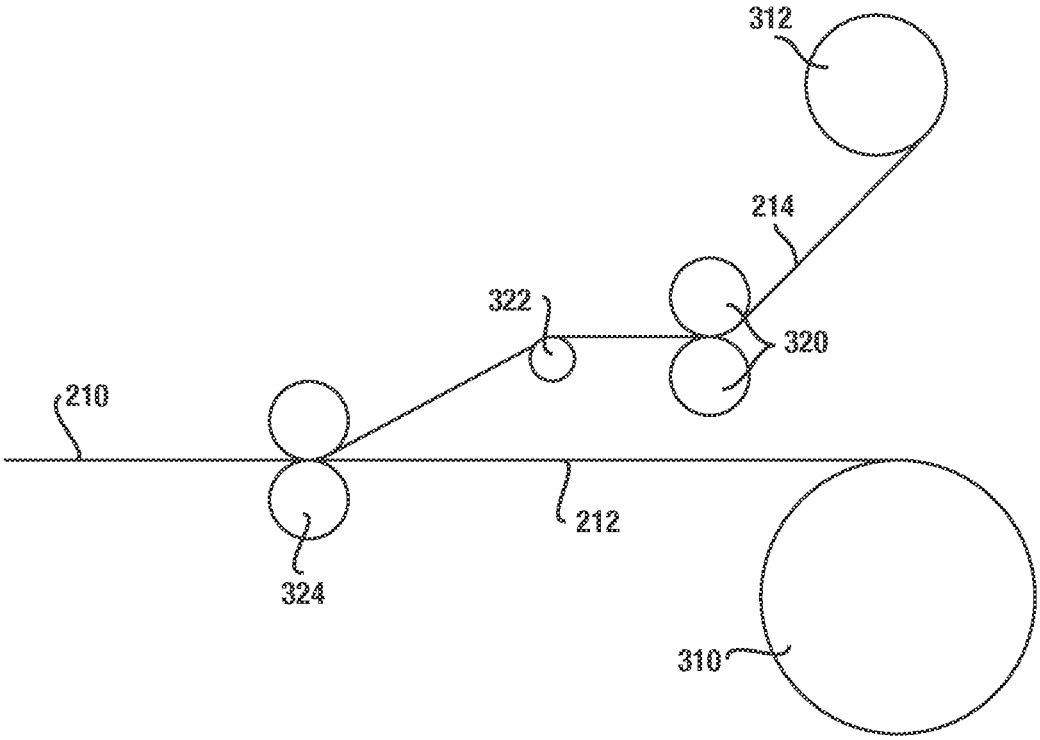

FIG. 7 provides an illustration of a process for manufacturing the drawstring of FIG. 6*a* and FIG. 6*b*.

DETAILED DESCRIPTION OF THE INVENTION

The present disclosure illustrates one or more preferred embodiments of the present invention. It is not intended to provide an illustration or encompass all embodiments contemplated by the present invention. In view of the disclosure of the present invention contained herein, a person having ordinary skill in the art will recognize that innumerable modifications and insubstantial changes may be incorporated or otherwise included within the present invention without diverging from the spirit of the invention. Therefore, it is understood that the present invention is not limited to those embodiments disclosed herein. The appended claims are intended to more fully and accurately encompass the invention to the fullest extent possible, but it is fully appreciated that certain limitations on the use of particular terms is not intended to conclusively limit the scope of protection.

As the term is used herein, "linear low density polyethylene," or LLDPE, is a category of polymer, specifically a category of polyethylene resin with a density below 0.930 g/cm$^3$ that is comprised of substantially linear polyethylene molecules with significant short-chain branching. LLDPE is typically made by copolymerization of ethylene with short-chain alpha-olefins as known in the art, although alternative methods of synthesizing LLDPE may be utilized. LLDPE may also include very low density polyethylene resin (VLDPE), which is also sometimes known as ultra low density polyethylene resin (ULDPE). VLDPE and ULDPE are typically defined as an LLDPE with a density of less than 0.906 g/cm$^3$.

As the term is used herein, "low density polyethylene," or LDPE, is a type of polymer, specifically a category of polyethylene resins with a density between 0.910 g/cm$^3$ and 0.940 g/cm$^3$ that is comprised of a high number of both short and long chain branching along the respective polyethylene molecules. Unlike LLDPE, LDPE is typically made through free radical polymerization and has a lower tensile strength than LLDPE but greater elasticity.

As the term is used herein, "high density polyethylene," or HDPE, is a type of polymer, specifically a category of polyethylene resins with density between 0.940 g/cm$^3$ to 0.970 g/cm$^3$ that is comprised of a greater proportion of crystalline regions than LDPE. The size and size distribution of crystalline regions are determinants of the tensile strength and environmental stress crack resistance of the end product. HDPE, with fewer branches than LDPE, HDPE has a greater proportion of crystals, which results in greater density and greater strength but also much lower elasticity in comparison to LDPE.

As the term is used within this particular disclosure, "elastic," describes a relative physical property of a material. A relatively elastic material is a material that may be elongated by tension and recover to a greater percentage to its original length than a material that is relatively inelastic. Elasticity of a polymer film may be measured by an industry accepted test, such as ASTM D-5449, known as the "Permanent Set Test." The relative elasticity of various common materials used by Applicant has been tested according to the Permanent Set Test to provide objective criteria for materials that are relatively elastic and relatively inelastic. As used herein in this particular disclosure, the term relatively elastic, or elastic in general, shall refer to a material that recovers at least 80% after a 20% elongation and a relatively inelastic, or inelastic in general, material shall refer to a material that recovers less than 80% after a 20% elongation, with elastic recovery as measured by ASTM D-5449.

As the term is used herein, "yield strength," describes the maximum tensile force a material may withstand without experiencing a permanent elongation and "elongation at yield" describes the elongation of a material when stretched to its yield strength versus its initial unstretched length.

It is customary for Applicant to refer to a drawstring trash bag when referring to the final product itself. However, when referring to the physical structure of the "drawstring," it is typically referred to as a drawtape. Therefore, although such usage may not necessarily be universal, even within this application, the term drawtape is frequently used when referring to the material used for the drawstring before the conversion process, i.e. before the process by which the drawstring is incorporated into a trash bag.

Looking at FIG. 1 and FIG. 2, side views of a drawstring bag 100 are depicted illustrating an embodiment of the present invention. In the depicted embodiment, the drawstring bag 100 is manufactured from a first panel 102 and a second panel 104. A fold forms the bag bottom 108 and seals 106*a* and 106*b* are provided along a first side 107*a* and a second side 107*b* of the respective first panel 102 and second panel 104. While this construction method is the preferred method for manufacture, the invention disclosed herein is not necessarily limited to any particular manufacturing method or construction.

As part of the drawstring trash bag 100, drawstrings 116*a*, 116*b*, 118*a* and 118*b* are provided within hems 112 and 114, each hem encompassing a pair of drawstrings, a first pair comprising drawstrings 116*a* and 116*b* and a second pair comprising drawstrings 118*a* and 118*b*. To provide the hems 112 and 114, an upper edge of the first panel 102 is folded over and sealed to form the first hem 112. Similarly, an upper edge of the second panel 104 is folded over and sealed to form the second hem 114. First and second drawstrings 116*a* and 116*b* are disposed within the first hem 112 and extend across the width of the first panel 102 while third and fourth drawstrings 118*a* and 118*b* are disposed within the second hem 114 and extend across the width of the second panel 104. For ease of illustration, FIG. 1 utilizes a different dashed line style to differentiate between the two drawstrings encapsulated in each hem.

In a preferred embodiment, the first and third drawstrings 116*a* and 118*a* are relatively inelastic while the second and third drawstrings 116*b* and 118*b* are relatively elastic. The second and fourth drawstrings 116*b* and 118*b* provide the necessary elasticity for the drawstring bag to fit snugly over a wide range of trash receptacle openings. The first and third drawstrings 116*a* and 118*a*, working in conjunction with the second and fourth drawstrings 116*b* and 118*b*, provide the necessary lifting capacity for a user to lift a full bag 100 out of a trash receptacle, close and tie the bag, and to carry it for disposal. In at least one preferred embodiment, the necessary lifting capacity is only provided by both pairs of drawstrings, 116*a/b* and 118*a/b* working in parallel; only a single drawstring in each hem does not provide the lifting capacity needed to remove a fully loaded bag from a container and to carry it away.

In a preferred embodiment, the respective ends of the first, second, third, and fourth drawstrings 116*a*, 116*b*, 118*a* and 118*b* are secured within the hems 112 and 114 by a pair of short seals 120 and 121 provided in the upper corners of the drawstring trash bag 100. The short seals 120 and 121 may generally be formed by applying a combination of heat and pressure in the locations shown in FIGS. 1 and 2. Each short seal seals or welds together an upper edge of the first panel 102, the first panel 102, an end of the four drawstrings 116*a*, 116*b*, 118*a* and 118*b*, the second panel 104, and the upper edge of the first panel 104. In an alternative embodiment, the respective ends of the first, second, third, and fourth drawstrings 116*a*, 116*b*, 118*a* and 118*b* are secured within the hems 112 and 114 only by the side seals 106*a* and 106*b* that secure the sides of the first panel 102 to the second panel 104. In some embodiments, including a depicted preferred embodiment, a drawstring bag 100 includes central access cutouts 110*a* and 110*b*. The central access cutouts 110*a* and 110*b* allow a user to pull the drawstrings 116*a*, 116*b*, 118*a* and 118*b* through the cutouts 110*a* and 110*b* to close the opening of the bag 100.

FIG. 3, which is not to scale, is a fractional cross-section of bag 100 that depicts drawstrings 116*a*, 116*b*, 118*a* and 118*a* disposed within hems 112 and 114 formed in the drawstring trash bag 100. To provide the hems containing the drawstrings 116*a*, 116*b*, 118*a* and 118*a*, the uppermost portion of the first and second panels 102 and 104 are folded over the drawstrings 116*a*, 116*b*, 118*a* and 118*a*, respectively. The first hem 112 is created after forming a hem seal on the first panel 102 while the second hem 114 is sealed by the hem seal on the second panel 104, encapsulating the drawstrings 116*a*, 116*b*, 118*a* and 118*a* within the respective hems 112 and 114. The hem seals may generally be formed by applying a combination of heat and pressure to each panel, sealing the two layers of polyethylene film together on each respective panel 102 and 104.

As shown in FIG. 3, first and second drawstrings 116*a* and 116*b* are arranged above and below each other within hem 112. Similarly, third and fourth drawstrings 118*a* and 118*b* are arranged above and below each other within hem 114. Shown in FIG. 4 is an alternative arrangement for each pair of drawstrings with each pair of drawstrings shown in a side-by-side arrangement within each hem 112 and 114. The arrangement of the drawstrings in FIG. 3 may be preferable since such an arrangement limits the number of layers welded by the short seals 120 and 121.

As known to a person having ordinary skill in the art, difficulty arises when attempting to weld multiple layers of polyethylene film together. Thus, it is desirable to limit the number layers of film that are welded together at a single location. As shown in FIG. 5, a preferred embodiment of the present invention limits the number of layers of film welded together at both ends of the hems. FIG. 5 illustrates an anchoring location of the drawstrings of the embodiment of the invention shown in FIG. 3.

FIG. 5 shows a first end of the first drawstring 116*a* welded to a first end of hem 112 of the bag 100 at a first upper short seal 120*a* and a first end of the second drawstring 116*b* welded to the first end of hem 112 at a first lower short seal 120*b*. A first end of the third drawstring 118*a* is welded to a first end of the second hem 114 at the upper short seal 120*a* and a first end of the fourth drawstring 118*b* is welded to the lower short seal 120*b*. Similarly, second ends of the first drawstring 116*a* and third drawstring 118*a* can be welded to a second end of hem 112 of the bag 100 at a second upper short seal (not shown) and second ends of the second drawstring 116*b* and fourth drawstring 118*b* can be welded to the second end of hem 112 at a second lower short seal (not shown).

The arrangement of the drawstrings 116*a*, 116*b*, 118*a* and 118*a* depicted in FIG. 5 limits the number of layers welded together at the short seals 120 and 121 and also places the drawstrings within the hems 112 and 114 above and below each other for easy access by a user of the drawstring trash bag 100. The short seals 120*a* and 120*b* may be formed by two separate welds or may also be formed by a single weld for ease of manufacturing. Furthermore, the short seals 120*a* and 120*b* may be separated by a certain amount of distance as shown in FIG. 5, may be placed so that a lower edge of seal 120*a* is in contact with an upper edge of seal 120*b*, or may be positioned where a limited amount of seal 120*a* overlaps with seal 120*b*.

In a preferred embodiment, if short seal 120*a* overlaps short seal 120*b*, the overlap is limited. For instance, upper short seal 120*a* can have an upper short seal height extending from an upper to a lower edge of short seal 120*a* and lower short seal 120*b* can have a lower short seal height extending form an upper to a lower edge of short seal 120*b*. Preferably, less than one-half of the upper short seal height overlaps with less than one-half of the lower short seal height. This overlap arrangement then leads to at least one-half of the upper short seal height in contact with both panel 102 and upper edge of panel 102 within hem 112. In a likewise fashion, at least one-half of the lower short seal height is then placed in contact with both panel 102 and the upper edge of panel 102 within hem 112.

In at least one preferred embodiment, the elastic second and fourth drawstrings 116*b* and 118*b* may be formed from a blend of LLDPE and LDPE as disclosed by the previously discussed '103 Application. This particular blend of polyethylene film provides the necessary elastic recovery, force-to-stretch (the effort required to stretch the film over a trash receptacle), and tensile strength at yield while utilizing cost-effective materials. The cold-stretched blend of LLDPE/LDPE, due to it comprising primarily LLDPE, is still capable of carrying a significant load in tension, with the addition of the LDPE surprisingly only negligibly affecting its yield strength and its elongation at yield. In another preferred embodiment, the drawtape film formed according to the '103 Application may further undergo a cold-stretched process as described in the previously discussed '958 Application. Use of the cold-stretch process increases the yield strength of the film and decreases the film's elongation at yield. For instance, a one-inch wide and approximately 3 mil thick film made from the aforementioned polyethylene blend according to the '103 Application, has been shown to have approximately a 7.4 pound yield strength and approximately a 104% elongation at yield. In contrast to this, the same material after undergoing the cold-stretch process has been shown to have a yield strength of approximately 10.4 pounds and an elongation at yield of approximately 54%.

The cold-stretch process of the '958 Application has also been shown to increase the elastic recovery of the drawtape film. For example, a one-inch wide and approximately 3 mil thick drawtape film made according to the '103 Application exhibited an elastic recovery of only 78% when tested according to the Permanent Set Test while film of the same construction with the cold-stretch process applied to it exhibited an elastic recovery of 89%. Hence, the cold-stretch process provides an elastic drawtape film capable of carrying a heavier load at a more useful length while also increasing the elastic recovery of the film.

When the force applied to a drawstring exceeds the yield strength of the drawstring, the drawstring will begin to stretch uncontrollably. Exceeding the yield strength results in permanent deformation and rapid, excessive elongation of the drawstring, making the yielding drawstring mostly useless to carry the load of the bag. Therefore, increasing the tensile strength at yield to 10.4 pounds from 7.4 pounds means that a cold-stretched drawtape film can effectively carry more weight than a drawtape film of the same material that has not been cold-stretched and having otherwise identical construction. The elongation at yield for the cold-stretch drawtape film is essentially half of the comparable non-cold-stretch drawtape film. Thus, reduced elongation of the cold-stretch drawtape film makes carrying a fully loaded trash bag utilizing the cold-stretched drawtape film easier.

Regarding the inelastic first and third drawstrings 116*a* and 118*a* of the present invention, an example of a relatively inelastic and cost-effective film is HDPE. Common examples of HDPE film are known to provide 10 to 11 pounds of yield strength for a one-inch wide film having a thickness of approximately 2.25 mils. The thickness or width of the inelastic drawtape film may be decreased if less lifting capacity is required and it also may be increased if additional lifting capacity is required.

In a preferred embodiment, the third drawstring 118*a* of the second hem 114 has the same structure and composition as the first drawstring 116*a* of the first hem 112. In a likewise manner, in a preferred embodiment, the fourth drawstring 118*b* of the second hem 114 has the same structure and composition as the second drawstring 116*b* of the first hem 112. In other words, the construction of the second hem 114 is identical to the first hem 112. Thus, for the sake of brevity, only the first pair of drawstrings, drawstrings 116*a* and 116*b* are discussed in detail below.

In a preferred embodiment, a working length of the first drawstring 116*a* is longer than a working length of the second drawstring 116*b* as shown in FIGS. 1 and 2. The working length is a path length of a drawstring between its two anchor points of the first short seal 120 and the second short seal 121. As previously mentioned, the first drawstring 116*a* is constructed from a relatively inelastic material, such as the HDPE drawtape film discussed above. The second drawstring 116*b*, as also previously discussed, is constructed from a relatively elastic material, such as the cold-stretched LLDPE/LDPE blend discussed above. The working length of the second drawstring 116*b* is shorter than the out-stretched width of the trash bag 100 between short seals 120 and 121 such that the hem 112 of the trash bag 100 gathers due to the shorter length of the first drawstring 116*b* pulling short seals 120 and 121 inwards towards each other. This gathering of hem 112 is shown by the surface texture lines of FIG. 1*b*. The first drawstring 116*a* gathers, or bunches up, along with the hem 112 but due to its greater degree of freedom, and its inherent greater degree of stiffness, has a tendency to loop outside of cutout 110*a*, as shown in FIG. 1*a* and FIG. 1*b* rather than bunching up throughout its length.

In one particular example, a distance between an inner end of the first short seal 120 and the inner end of the second short seal 121 of an outstretched bag 100, i.e. the inner hem width, is approximately 23 inches while the working length of the second drawstring 116*b* is approximately 21 inches and the working length of the first drawstring is 116*a* is the same length as the inner width of the two short seals, 23 inches. These dimensions result in the hem 112 and first drawstring 116*a* gathering or bunching up about two inches as illustrated in FIG. 1*b*, the texture lines of the figure illustrating the gathering or bunching of the hems 112 and 114.

As discussed above, the invention contemplates the elastic drawstrings 116*b* and 118*b* having a shorter working length than a width between the inner edge of short seals 120 and 121. One method of manufacturing bag 100 with these properties is to out-stretch the elastic drawstrings 116*b* and 118*b* prior to sealing the drawstrings within the hems 112 and 114 with short seals 120 and 121. To prevent the short seals 120 and 121 from failing, it is necessary to stretch an inner length of the elastic drawstrings 116*b* and 118*b* so that the ends of the drawstrings are not in tension when short seals 120 and 121 are made. If the ends of the elastic drawstrings 116*b* and 118*b* are under tension when a the short sealing operation is performed, there is a risk that the seals will fail since the molten material formed during the sealing operation will pull away resulting in the drawstrings 116*b* and 118*b* not sealed to the hems 112 and 114. In contrast to the elastic drawstrings, the inelastic drawstrings 116*a* and 118*a* are not stretched when incorporated into the bag 100 and hence the working length of the inelastic drawstrings 116*a* and 118*a* is the same as the out-stretched inner width between the inner edges of short seals 120 and 121.

The second drawstring 116*b*, and in cooperation with it, the fourth drawstring 118*b*, having such shorter lengths than known drawstring trash bags, allows the bag 100 to fit over trash containers with a greater range of upper lip circumferences or perimeters (i.e. the opening of the trash container) than other known drawstring trash bags utilizing similar construction and materials. For instance, the circumference or perimeter of the opening of a typical kitchen trash receptacle can vary from at least 42 to 50 inches. With the initial circumference of trash bag 100 limited to 42 inches, due to the working length of the two shorter elastic drawstrings 116*b* and 118*b* of 21 inches, drawstring trash bag 100 is capable of snugly adhering to trash receptacles with an upper lip perimeter as small as 42 inches. In certain embodiments, the elastic drawstrings 116*b* and 118*b* may be formed even shorter so that bag 100 may fit over receptacles with even smaller openings.

Although the shorter drawstrings 116*b* and 118*b* allow bag 100 to fit snugly over a greater range of receptacle openings, the shorter length of the second and fourth drawstrings 116*b* and 118*b* would be expected to require a greater amount of effort to stretch the drawstrings over receptacles with larger openings than bags with longer drawstrings of similar construction. However, in at least one preferred embodiment, the second and fourth drawstrings 116*b* and 118*b* are only one-half the width of a typical drawstring, lessening the otherwise higher effort that would be required to stretch the drawstring trash bag 100 over trash receptacles with larger openings. Each drawstring also limits the material cost of bag 100. In at least one preferred embodiment, the first and third drawstrings 116*a* and 118*a* also have a width of approximately one-half the width of a typical drawstring so that each pair of drawstrings, laying side-by-side, have approximately the same width as a single typical drawstring.

Throughout the trash bag industry, drawstrings widths are typically one inch wide while drawstring thickness varies depending upon drawtape material. For LLDPE drawtapes, a common material used in the manufacture of drawstrings, a nominal thickness of between 3 and 5 mils is typical and for HDPE drawtapes a nominal thickness of between 2 and 2.5 mils is typical. These dimensions provide the necessary yield strength of approximately 10 lbs, depending upon the particular properties of the materials used. This provides for a drawstring trash bag capable of lifting a bag weighing approximately 40 pounds with the weight distributed evenly over the four sections of the drawstring. The thickness of any particular drawtape film may be decreased to lower the cost of a drawstring trash bag if less lifting capacity is required. The thickness of any particular drawtape film may also be increased if additional lifting capacity is required. However, the overall weight capacity of a drawstring trash bag may be limited to other design factors, such as the strength of the film forming the panels and hems of the bag, or the strength of the side seals and hem seals welding the various components of the bag together.

With the typical drawstring having a width of one inch, in a preferred embodiment of the present invention, each drawstring of trash bag 100 has a width of approximately one-half inch. With the width of the shorter elastic drawstrings 116*b* and 118*b* one-half of a typical drawstring, the initial effort required to pull the drawstring bag over a typical trash receptacle is lessened to one-half, since the tensile resistance of the film is directly related to its cross-sectional area. For trash receptacles of smaller openings, the inelastic longer drawstrings 116*a* and 118*a* do not factor into the effort required to place the trash bag 100 over trash receptacles having a perimeter of 48 inches or less, since no stretching of the inelastic drawstrings is necessary due to the longer length of these drawstrings.

Even though the effort required increases as the drawstring 116*b* and 118*b* are elongated further, the effort remains less than is required for a typical one-inch wide drawstring, at least for trash receptacles having openings of 48 inches or less utilizing a preferred embodiment of the present invention. For example, testing shows that as little as 6.5 pounds would be required to stretch trash bag 100 of the preferred embodiment over a receptacle having a 48 inch perimeter. However, if the drawstring bag 100 is pulled over a trash receptacle opening having a perimeter greater than 48 inches, the longer inelastic drawstrings 116*a* and 118*a* would be required to stretch. Testing has shown that a prior art drawstring trash bag with one-inch HDPE drawstrings and a 24 inch width, such as the inelastic drawstrings of a preferred embodiment of the present invention, requires a force of approximately 23 pounds to be stretched over a trash receptacle with a 50 inch opening. Testing has also shown that a prior art trash bag with a cold-stretched elastic drawstring requires a force of approximately 13 pounds to be stretched around the same trash receptacle opening. Based upon these test results, it is estimated that a preferred embodiment of trash bag 100 would require a force to stretch around the same receptacle an average of these two values, approximately 17.5 pounds.

Drawstring trash bags constructed with HDPE drawtapes often times are known to poorly grip the openings of many trash receptacles due to the marginal elasticity of HDPE. For trash receptacles within a narrow range, HDPE drawstring trash bags may be able to adhere to a trash receptacle opening. For trash receptacles larger than the opening of the trash bag, it may be possible for a user to stretch HDPE drawstring over the receptacle's opening. However, for receptacles with very larger openings, once the bag is stretched over the receptacle, it is possible that the bag will not snugly adhere to the receptacle if the HDPE drawstrings were overstretched and the limited elastic recovery of the HDPE drawstrings have been exceeded. However, with the present invention, even though the HDPE drawstrings may have exceeded their elastic recovery to fit over a larger receptacle, the elastic drawstrings, having a much greater range of elastic recovery, will recover after being pulled around larger receptacles and provide a snug fit to the receptacle. Furthermore, since the widths of the inelastic drawstrings 116*a* and 118*a* are a fraction of prior art HDPE drawstrings, the effort to pull the drawstrings over a large receptacle is significantly reduced.

While the disclosed invention provides a drawstring trash bag that fits over a wider range of trash receptacles while requiring less effort to fit over many of these trash receptacles than prior art drawstring trash bags, it also provides the necessary strength to be able to lift a full trash bag out of a receptacle and to carry it away. As previously mentioned, one reason that one-inch wide drawstrings have become accepted throughout the industry is that such a width provides the required lifting strength with commonly available and cost effective materials. Thus, it follows that the one-half inch wide elastic drawstrings 116*a* and 118*b* of the present invention, when constructed out of HDPE, do not provide the necessary lifting capacity standing alone. Hence, the elastic drawstrings 116*b* and 118*b* must provide part of the necessary lifting capacity.

In an exemplary embodiment, it is estimated that a trash bag utilizing only one-half inch wide elastic drawstrings 116*b* and 118*b*, as contemplated by the invention and constructed from the previously discussed cold-stretched blend of LLDPE/LDPE, with a thickness of approximately 3 mils, would have a maximum lifting capacity of 20 pounds, with each of the four drawstring sections having approximately a five pound yield strength each. However, when one-half inch elastic drawstrings 116*b* and 118*b* are used in conjunction with one-half inch wide inelastic drawstrings 116*a* and 118*a* constructed from the previously discussed HDPE, the cumulative effect of both drawstrings working in parallel provides a lifting capacity of approximately 40 pounds; the maximum expected weight of a typical kitchen drawstring trash bag.

Each of the drawstrings, both the elastic and inelastic drawstrings 116*a*, 116*b*, 118*a* and 118*a*, work together to carry the load once the elastic drawstrings 116*b* and 118*b* are stretched to the length of the inelastic drawstrings 116*a* and 118*a*. Furthermore, once the elastic drawstrings 116*b* and 118*b* stretch to the length of the inelastic drawstrings 116*a* and 118*a*, the elongation of the drawstrings 116*a*, 116*b*, 118*a* and 118*a* decreases significantly, when a fully weighted bag 100 is lifted, due to the limited elasticity of the inelastic drawstrings 116*a* and 118*a*. Each inelastic drawstring 116*a* and 118*a*, with a thickness of 2.25 mils and a width of one-half inch, may carry approximately a five pound load each. The inelastic drawstrings 116*a* and 118*a* may also be made wider or thicker to provide a higher lifting capacity if necessary.

Shown in FIGS. 6*a* and 6*b* is an alternative embodiment of the present invention. Shown in FIG. 6*a* is a partial view of drawstring bag 200 formed from a continuous folded web. Shown incorporated into bag 200 is drawstring 210. Further shown on both sides of bag 200 are sides of adjacent bags formed from the continuous folded web. FIG. 6*a* also shows first short seal 220, second short seal 221, and side seals 206. Also shown are perforations 230 on each side of bag 200. Drawstring 210 is incorporated into bag 200 by common converting processes as known to persons skilled in the art. Drawstring 210 is affixed to bag 200 by short seals 220 and 221.

The structure of drawstring 210 is shown more clearly in FIG. 6*b*, which shows a fragmented length of drawstring 210. Drawstring 210 is formed by an inelastic drawtape 212 and an elastic drawtape 214. Elastic drawtape 214 is placed centrally along inelastic drawtape 212. A longitudinal axis of elastic drawtape 214 is centered about a longitudinal axis of inelastic drawtape 212 with a first surface of elastic drawtape 214 affixed to an adjacent first surface of inelastic drawtape 212. The surfaces of drawtapes 212 and 214 may be affixed to each other via adhesive or other means known to a person skilled in the art, such as heat sealing.

In at least one preferred embodiment, inelastic drawtape 212 is formed with a relatively inelastic material such as HDPE while elastic drawtape 214 is formed with a relatively highly elastic material. The highly elastic material can include non-heat-shrinkable polymers such as block copolymers which are elastomeric, such as as A-B or A-B-A block copolymers. Styrene/isoprene, butadiene, or ethylene-butylene/styrene (SIS, SBS, or SEBS) block copolymers may also be particularly useful. Other useful elastomeric compositions can include elastomeric polyurethanes, ethylene copolymers such as ethylene vinyl acetates, ethylene/propylene copolymer elastomers or ethylene/propylene/diene terpolymer elastomers. The relatively inelastic drawtape 212 may be formed from other common materials such as LLDPE, blends of HDPE/LLDPE, or other commonly known polymeric materials.

As shown in FIG. 6*b*, inelastic drawtape 212 has a width much greater than a width of elastic drawtape 214. In at least one preferred embodiment, drawtape 212 can have an approximate nominal width of one inch while drawtape 214 can have an approximate nominal width between ¼ and ¼ inch. Unlike previous embodiments, adjacent planar surfaces of drawtapes 212 and 214 are affixed to each other prior to being incorporated into bag 200.

Elastic drawtape 214 is stretched prior to being affixed to drawtape 212. In at least one preferred embodiment, elastic drawtape 214 is stretched approximately 10% in relation to its original length. In various embodiments, elastic drawtape 214 may be stretched as little as 5% and as much as 50%, but ideally between 15% and 25% prior to being adhered to inelastic drawtape 212. Due to its high elasticity, elastic drawtape 214 is typically capable of recovering approximately 100% after being stretched. Hence, once elastic drawtape 214 is adhered to inelastic drawtape 212, it places both drawtapes 212 and 214, now drawstring 210, under tension. Once drawstring 210 is incorporated into drawstring bag 200, the hem 222 of bag 200 will have a tendency to gather due to drawstring 210 attempting to recover to the unstretched length of elastic drawtape 214.

Shown in FIG. 7 is an exemplary process for forming drawstring 210. Elastic drawtape 214 and inelastic drawtape 212 are shown unrolling from feedstock rolls 310 and 312. Elastic drawtape 214 unrolls from roll 312 and then passes through stretching nip rollers 320. After passing through stretching nip rollers 320, elastic drawtape 214 passes over adhesive roller 322. The surface of adhesive roller 322 can be supplied with an adhesive that is applied to a first surface of drawtape 214 as it comes into contact with the circumferential surface of adhesive roller 322. The adhesive may be applied to drawtape 214 continuously or intermittently. Intermittent application of the adhesive may be desirable as discussed below. Once elastic drawtape 214 rolls over adhesive roller 322, it enters affixing nip rollers 324. In at least one alternative embodiment, an adhesive may be applied to inelastic drawtape 212 rather than elastic drawtape 214. Adhesive may also be applied to both inelastic drawtape 212 and elastic drawtape 214.

Affixing nip rollers 324, as shown in FIG. 7, rotate faster than stretching nip rollers 322. The difference in speed between the sets of nip rollers stretches the elastic drawtape 214 prior to it being adhered to inelastic drawtape 212. The difference in speed can be varied based on the amount of stretching desired in drawtape 212. As discussed above, the amount of stretch, and hence the approximate difference in speed between the sets of nip rollers 320 and 324, can vary between approximately 5% and 50% with an ideal speed difference between 15% and 25%. Inelastic drawtape 212 rolls directly from feedstock roll 310 to nip rollers 324. Hence, inelastic drawtape 212 is not stretched in the construction of drawstring 210. Drawtapes 212 and 214 are pressed together by nip rollers 324; bringing a surface of elastic drawtape 212 into contact with an adjacent surface of inelastic drawtape 214 so that the adhesive adheres the two drawtapes 212 and 214 together, forming drawstring 210.

If adhesive has been applied intermittently to one or more drawtapes 212 and 214, then the two drawtapes may be affixed to each other in affixed sections and not affixed to each in non-affixed sections. This intermittent affixation of drawtapes 212 and 214 may be desirable to control the bunching of inelastic drawtape 212 once tension in drawstring 210 is released and elastic drawtape 214 recovers or attempts to recover to its original unstretched length. The distance between affixed sections and non-affixed sections may vary greatly, but in one preferred embodiment, adhesive may be applied to one or more drawstrings 212 and 214 so that a gap of ¼-inch to ⅜-inch exists between each affixed section and a length of approximately 1/16-inch to ⅛-inch of both drawtapes 212 and 214 are affixed to each other with adhesive between each non-affixed section. In at least a preferred embodiment, the spacing of affixed and non-affixed sections repeats evenly for the length of drawstring 210. Furthermore, in an alternative embodiment, heat sealing can be applied to drawtapes 212 and 214 to achieve the same structure of affixed and non-affixed sections for drawstring 210.

Returning to FIG. 6*a*, due to the stretching of drawtape 214, drawstring 210 is under tension when assembled into bag 200. A continuous length of drawstring 210 is inserted onto a continuous folded web and then a continuous hem 222 is formed from the continuous folded web, the hem 222 encapsulating drawstring 210. Short seals 220 and 221 are then formed in hem 222. Once short seals 220 and 221 are formed, the folded web can be perforated, the perforations defining first and second sides of bag 200. Since the continuous drawstring 210 is held by nip rollers (not shown) on both sides of bag 200 when short seals 220 and 221 are formed, tension is equalized in drawstring 210 and short seals 220 and 221 may be formed in drawstring 210 and hem 222 without drawstring 210 pulling away from short seals 220 and 221 and causing the seals to fail.

Once drawstring bag 200 is completely formed, the perforations 230 may be broken. Once perforations 230 are broken, the tension held in drawstring 210 will be released; with the perforations separated, the nip rollers on both sides of bag 200 will no longer hold any tension in drawstring 210. Once tension in drawstring 210 is released, hem 222 will begin to bunch when elastic drawtape 214 attempts to recover to its original unstretched length. Elastic drawtape 214 returning to its original length will also cause drawstring 210 to bunch up within hem 222.

In an alternative embodiment, the perforations 230 may not be broken, but rather the continuous web of formed drawstring bags 200 may be rolled into a roll of bags with the tension released once the roll is complete. The roll of bags will attempt to recover once on the roll but may largely be prevented from recovering due to friction in the roll of bags. However, once a bag is removed from the roll, or is on an exterior of the roll of bags, the removed bag may begin to recover and the hem of the bag will begin to gather due to the elastic drawtape 212 attempting to return to its original length.

Unlike previous embodiments of the invention, due to the high elasticity of drawtape 214, only inelastic drawtape 212 is capable of carrying any significant load of drawstring bag 200. Hence, in at least one preferred embodiment, drawtape 212 has a nominal approximate width of one-inch and a thickness of approximately 2.25 mils for an inelastic drawtape 212 constructed from HDPE. As previously discussed, elastic drawtape 212 with these dimensions should provide for a total carrying capacity of 40 pounds when incorporated into drawstring bag 200.

As discussed above, the width of elastic drawtape 214 can vary greatly, but for ease of manufacturing, a width of ¼ to ½ inch may be desirable. Depending upon the material selected for the elastic drawtape 214 and the material's corresponding tensile and elastic properties, a thickness of elastic drawtape 214 may vary from 0.5 mils to 6 mils. It may be desirable for the elastic drawtape 214 to have a lower thickness relative to inelastic drawtape 212 to prevent the elastic drawtape 214 from interfering with the formation of short seals 221 and 222, and also to limit the amount of effort required to pull drawstring 210 through hem 222 by limiting the surface contact between drawtape 214 and hem 222.

Due to the high elasticity of the elastic drawtape 214, the drawstring 210 may be designed to gather the hem 222 of drawstring bag 200 a considerable amount. For instance, if drawtape 214 is out-stretched 20% and the working length of drawstring 210 is 24 inches, gathering of the hem exceeding 4 inches can be expected. Thus, drawstring bag 200 can adhere to trash receptacles with openings as small as 20 inches or less. Also, due to its high elasticity and relatively low tensile strength, drawstring bag 200 should provide relatively low resistance to being stretched over trash receptacles, at least until the un-gathered length of the drawstring 210 is met or exceeded.

As noted, the embodiments depicted herein are not intended to limit the scope of the present invention. Indeed, it is contemplated that any number of different embodiments may be utilized without diverging from the spirit of the invention. Therefore, the appended claims are intended to more fully encompass the scope of the present invention.

We claim:

1. A drawstring bag comprising:

a first panel and a second panel, the first panel and the second panel joined along a first side, a bottom, and a second side, the first panel and the second panel thereby defining an upper opening of the bag, a first hem located along the upper opening of the bag in the first panel, a first drawstring disposed within the first hem, a second drawstring disposed within the first hem, the first panel, the second panel, the first drawstring, and the second drawstring welded together proximate to the first side by one or more first short seals, the first panel, the second panel, the first drawstring and the second drawstring welded together proximate to the second side by one or more second short seals, the first drawstring having a working length greater than a working length of the second drawstring, and the second drawstring having an elongation at yield of less than 100% such that the second drawstring experiences a permanent deformation when elongated less than 100%.

2. The drawstring bag of claim 1 further comprising:

a first end of the first drawstring located approximately above a first end of the second drawstring.

3. The drawstring bag of claim 2 further comprising:

the first end of the first drawstring not overlapping the first end of the second drawstring so that the entire height of the first end of the first drawstring is welded to an upper edge of the first and second panels.

4. The drawstring bag of claim 1 further comprising:

a width of the first drawstring approximately one-half inch or less, and a width of the second drawstring approximately one-half inch or less.

5. The drawstring bag of claim 1 further comprising:

a thickness of the first drawstring less than a thickness of the second drawstring.

6. The drawstring bag of claim 1 further comprising:

an inner bag opening length defined by an out-stretched distance between an inner edge of the one or more first short seals and an inner edge of the one or more second short seals, the working length of the second drawstring less than the inner bag opening length, and the working length of the first drawstring equal to or greater than the inner bag opening length.

7. The drawstring bag of claim 1 further comprising:

the first drawstring inelastic, and the second drawstring elastic.

8. The drawstring bag of claim 1 further comprising:

the second drawstring comprising a blend of LLDPE and LDPE.

9. The drawstring bag of claim 1 further comprising:

the second drawstring subjected to cold stretching.

10. A drawstring bag comprising:

a first panel and a second panel, the first panel and the second panel joined along a first side, a bottom, and a second side, the first panel and the second panel thereby defining an upper opening of the bag, a first hem located along the upper opening of the bag in the first panel, a first drawstring disposed within the first hem, a second drawstring disposed within the first hem, the first panel, the second panel, the first drawstring, and the second drawstring welded together proximate to the first side, the first panel, the second panel, the first drawstring and the second drawstring welded together proximate to the second side, the first drawstring having a working length greater than a working length of the second drawstring, and the second drawstring having an elongation at yield of less than 100% such that the second drawstring experiences a permanent deformation when elongated less than 100%.

11. The drawstring bag of claim 10 further comprising:

a first end of the first drawstring located approximately above a first end of the second drawstring.

12. The drawstring bag of claim 10 further comprising:

the second drawstring having a yield strength of at least approximately five pounds and a thickness of approximately 3 mils or less.

13. The drawstring bag of claim 12 further comprising:

a thickness of the first drawstring less than a thickness of the second drawstring.

14. The drawstring bag of claim 10 further comprising:

an inner bag opening length defined by an out-stretched distance between an inner edge of the first side and an inner edge of the second side, the working length of the second drawstring less than the inner bag opening length, and the working length of the first drawstring approximately equal to the inner bag opening length.

15. The drawstring bag of claim 10 further comprising:

the first drawstring inelastic, and the second drawstring elastic.

16. The drawstring bag of claim 15 further comprising:

the second drawstring having a yield strength at least 50% and less than 100% of a yield strength of the first drawstring.

17. The drawstring bag of claim 10 further comprising:

the second drawstring comprising a blend of LLDPE and LDPE.

18. The drawstring bag of claim 10 further comprising:

the second drawstring subjected to cold stretching.

* * * * *